United States Patent [19]

Guido et al.

[11] 3,985,294

[45] Oct. 12, 1976

[54] FURNACE PRESSURE CONTROL

[75] Inventors: Paul Vincent Guido, Cedar Grove; Robert Lenox Criswell, Florham Park, both of N.J.

[73] Assignee: Foster Wheeler Energy Corporation, Livingston, N.J.

[22] Filed: Aug. 4, 1975

[21] Appl. No.: 601,892

[52] U.S. Cl. ..... 236/15 C; 236/15 B

[51] Int. Cl.[2] ..... F23N 3/06

[58] Field of Search ..... 236/15 C, 14, 15 B; 110/40 B

[56] References Cited

UNITED STATES PATENTS

| | | | |
|---|---|---|---|
| 2,160,968 | 6/1939 | Hagen | 236/15 C UX |
| 3,169,703 | 2/1965 | Martz | 236/15 C |
| 3,889,877 | 6/1975 | Kivlen | 236/15 C |

*Primary Examiner*—William E. Wayner
*Attorney, Agent, or Firm*—Marvin A. Naigur; John E. Wilson

[57] ABSTRACT

There has been provided a control for regulating the pressure excursions in a furnace having forced draft and induced draft fans. A pressure detector responsive to pressure in the furnace delivers an output indicative thereof. Circuit means, responsive to the pressure detector means and a set point input, delivers a correction signal output. Fan control means coupled to the induced draft fan is responsive to a demand input signal corresponding to a desired flow rate through the furnace and is likewise responsive to the correction signal for delivering a fan control signal for regulating said induced draft fan in accordance with variations in the flow rate and pressure excursions in the furnace. An override circuit is responsive to the pressure detector and an override set point input to produce an override output for controlling the induced draft fan at a rate substantially higher than that of the correction signal. There is also provided a transfer and memory circuit responsive to combustion air flow to the furnace and a furnace trip condition such that the circuit produces a signal to modify said fan control signal in accordance with the actual air flow to the furnace and in anticipation of an inevitable furnace pressure excursion caused by said furnace trip.

23 Claims, 6 Drawing Figures

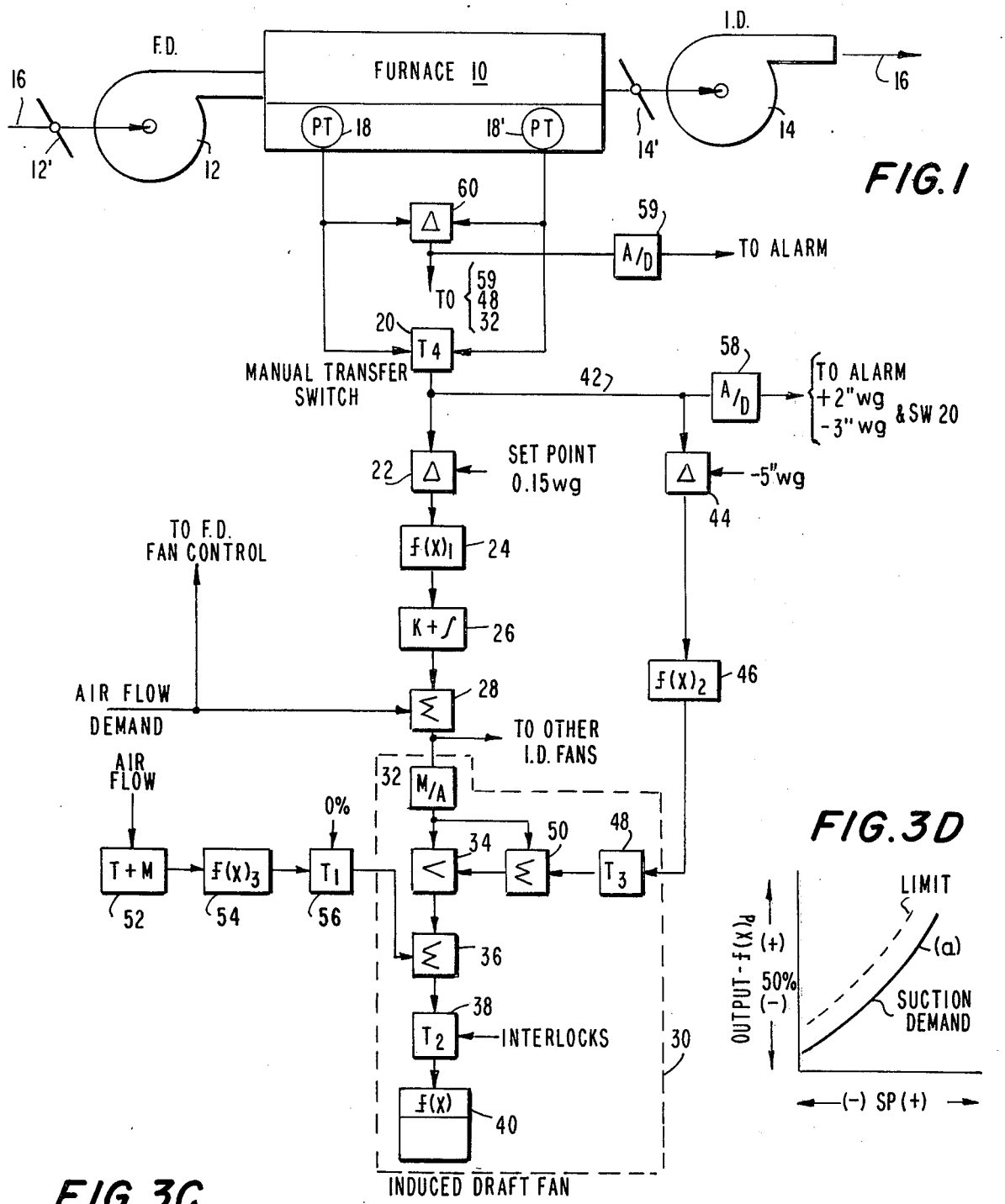
FIG. 1
FIG. 3D
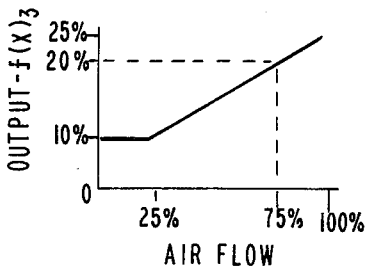
FIG. 3C
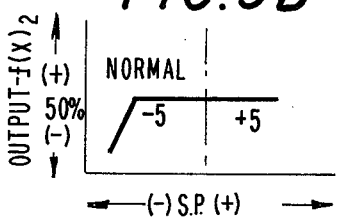
FIG. 3B
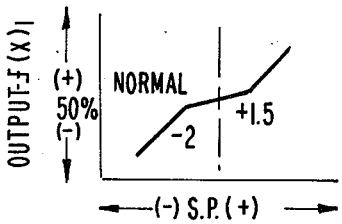
FIG. 3A

I.D.
114
114'
FURNACE 110
(±10")
PT
118'
118
F.D.
112
112'
116
TO ALARM
159
A/D
160
TO
159
148
132
T4
120
SET POINT
-0.15 wg
MANUAL
TRANSFER
SWITCH
122
124
f(x)1
K+f
126
AIR FLOW
DEMAND FROM
COMB. CONTROLS
128
TO F.D. FAN
CONTROL
MEASURED
AIR FLOW
f(x)
172
170
I.D
SUCTION FAN
176'
176
TO
ALARM
179
/L
178
174
K
180
TO ALARM
+2" wg
-3" wg
158
A/D
-5 wg
144
146
f(x)2
130
148
T3
150
TO OTHER
I.D. FANS
M/A
132
134
136
INTERLOCKS
138
T2
140
f(x)
INDUCED DRAFT
FAN
0%
T1
156
f(x)3
154
AIR FLOW
T+M
152

FURNACE PRESSURE CONTROL

BACKGROUND OF THE INVENTION

Pressure changes, especially negative pressure excursions in boiler furnaces, are the subject of growing concern to designers and manufacturers of large utility type boilers.

Boilers with both induced and forced draft fans may become unbalanced expecially if the forced draft unit becomes tripped and the induced fan unit remains in full operation. The induced draft fan will produce an excessive draft in the furance and create the real likelihood of furnace implosion.

Boiler furnaces are designed larger each year and consequently the draft head requirements increase owing both to the increased size of the units and also to environmental considerations. Therefore protection from the occurrence of a highly unbalanced furance draft is becoming a required safety feature.

A negative pressure excursion of −5 inches Wg. represents an impending danger, if the excursion decreases to furnace design values and lasts for an excessive period of time. A pressure exursion of −5 inches Wg. represents an emergency situation requiring a fan trip for emergency regulation of the draft in the furnace.

While there are systems which are used to control forced draft fans and induced draft fans for creating certain combustion characteristics in the furnace, there is definite need for a system which, in addition to controlling the flow characteristics of the furnace, reduces the possibility of boiler implosion by detecting the aforementioned dangerous and emergency situations.

It is therefore an object of the present invention to provide a system which will prevent, by suitable warning and control, the dangers caused by excessive pressure excursions in a boiler furnace.

SUMMARY OF THE INVENTION

There has been provided a control for regulating pressure excursions in a furnace having forced draft and induced draft fans for creating a desired flow of gas through the furnace. The system includes a pressure detector located in the furnace being responsive to pressure therein for delivering an output indicative of said excursions. Means produces a set point signal corresponding to a required furnace pressure and circuit means responsive to the pressure detector means and the set point signal delivers a correction output. Flow demand means delivers a demand output corresponding to the desired flow rate through the furnace, Fan control means response to the demand output and the correction signal delivers a control signal to the induced draft fan so as to modify the flow of gas through the furnace in accordance with variations in said correction signal and demand signal. Circuit means produces an override set point signal corresponding to excessive furnace pressue excursions and override means responsive to the pressure detector output and the override set point produces an override output signal for said fan control means. Said control means for the induced draft fan response to the override signal for modifying the furnace gas flow to compensate for the excessive pressure excursion at a rate substantially faster than the variations in the control signal. There is also provided a transfer and memory circuit responsive to combustion air flow to the furnace trip condition such that the circuit produces a signal to modify said fan control signal in accordance with the actual air flow to the furnace and in anticipation of an inevitable furnace pressure excursion caused by said furnace trip.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention, when taken in connection with the accompanying drawings, wherein:

FIG. 1 is a block diagram showing control circuitry of the present invention coupled to a furnace having forced draft and induced draft fans shown in plan view;

FIGS. 3A-C illustrate graphically wave forms generated at different stages of the control circuitry of FIGS. 1 and 2, used to establish control and reference signals;

FIG. 3D illustrates graphically a wave form generated in a function generator for establishing a reference and control signal for an aspect of the embodiment shown in FIG. 2.

DESCRIPTION OF THE PREFERRED EMBODIMENTS

Figure 2:
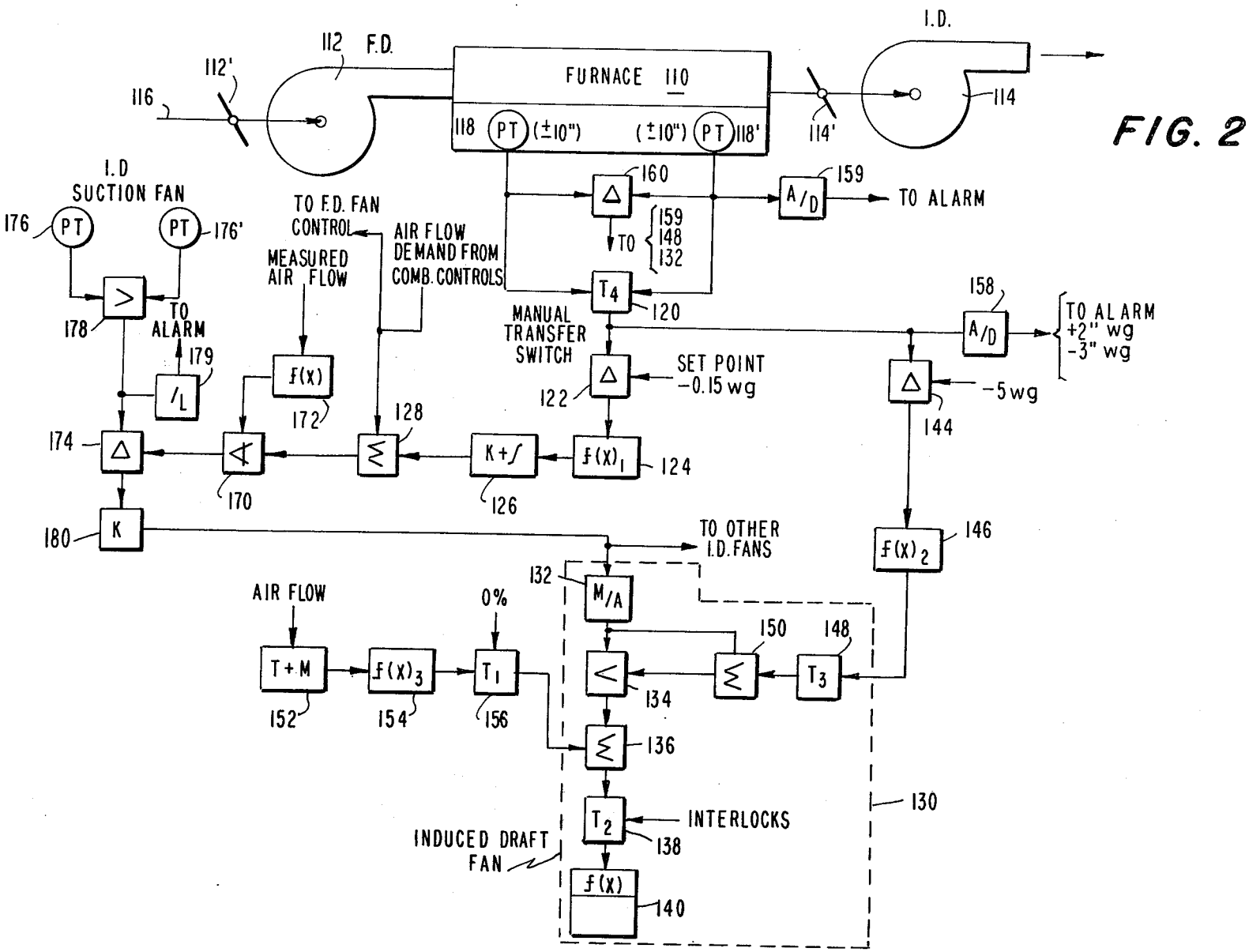
FIG. 2 is a block diagram illustrating another embodiment of the invention illustrated in FIG. 1.

In accordance with FIG. 1 of the present invention, there is provided a control for regulating pressure excursions in a furnace 10 having forced draft fan 12 and induced draft fan 14, respectively abbreviated hereafter as FD and ID, fans for creating a desired flow rate of gases through said furnace 10 illustrated by the arrows 16. As will be explained further in the description, pressure detectors 18 and 18' are disposed in a wall of the furnace 10. The pressure detectors 18, 18' may be mechanical or electromechanical transducers which produce electrical signals indicative of pressure in the furnace 10. The signals are transmitted through a manual transfer switch 20 to a comparator 22. The comparator is set with an input set point as noted in the drawing of −0.15 inch Wg. This set point for comparator 22 is used as a standard for normal operation of the furnace 10. The output of the comparator 22 is coupled to a function generator 24 which has an output characteristic as illustrated in FIG. 3A. The output of the signal generator 24 varies about a nominal fifty percent level at the set point for comparator 22 and produces an increase or decreasing signal as the input to the comparator varies about the set point −0.15 inch WG. The output of the function generator 24 is coupled to a proportional (K) and integral ( $\int$ ) correction circuit 26. The proportion factor K provides a useful signal level and the integral factor tends to smooth out variations in the response of the output of function generator 24. The output of the correction circuit 26 is coupled to a summing circuit 28 which receives an air flow demand input which is summed with the output of the correction circuit 26. Air flow demand is a signal which is a function of the combustion characteristics of the fuel being burned and the demand on the furnace at a particular time. The air flow demand signal is delivered to this portion of the furnace to draft control so that an operating range about which the pressure varies is established. For example, at high furnace load the air demand to the furnace is likewise quite high, consequently the ID fan 14 and FD fan 12 must be operating at a considerably higher flow. If damper control of flow is used, the respective dampers 12' and 14' of fans 12 and 14 are set to a condition which permits greater air flow. It should be understood that fan speed or damper control could be used to control flow through the furnace as required by the design specification for the particular furnace utilizing the pressure control of the present invention.

The air flow demand signal establishes the pre-determined ID fan damper position required to maintain the furnace pressure at the setpoint. Due to conditions within the furnace, which would affect air flow, such as dirt or slag or other variables such as a change in the position of dampers within the furnace which would affect the resistance to flow, the demand signal may position the ID damper such that furnace pressure varies from setpoint. In this case the pressure detectors 18 and 18' will detect this deviation and through the comparator 22, function generator 24 and correction circuit 26 modify the air flow demand signal from the summing circuit 28 in such a manner to correct the damper position.

In the present system the output of the summing circuit 28 is a control signal proportional to the sum of the demand signal and a correction signal which represents the variations to be imposed on that demand signal which is a function of the furnace pressure.

The control output of the summing circuit 28 is delivered to the fan control circuit 30 which includes a manual to auto switch 32 the purpose of which will be explained later in the discussion, a lower selection circuit 34 coupled to a summing circuit 36, interlock circuit 38 and fan capacity control circuit 40. Under normal conditions the control signal produced at summing circuit 28 is communicated directly to the fan circuit 40 and controls the ID fan 14 according to variations in the output of the summing circuit 28. It should be understood that, the output of the summing circuit 28 is somewhat slow in its response, because under normal conditions, sudden changes in the control of the ID fan 14 is undersirable.

In addition to the foregoing control circuit an override circuit is provided which includes a signal path 42 from the manual transfer switch output 20 to a comparator circuit 44. The comparator circuit 44 has a set point input of −5 inch Wg. This input represents an override condition which requires rapid changes in the operation of the ID fan 14. The output of the comparator 44 drives a function generator 46 which has an output illustrated in FIG. 3B. The output of the function generator 46 remains at a nominal 50 percent signal level about the set point −5 inch Wg., but changes drastically to produce an override signal in a negative direction at −5 inch Wg. The output of function generator 46 is coupled to a switching circuit 48 and thereafter to summing circuit 50. The summing circuit 50 receives an input from the function generator 46 through switching circuit 48 and also an input from summing circuit 28 through manual-auto circuit 32. The input from manual-auto circuit 32 tends to stabilize the output of summing circuit 50 which in turn is coupled to the lower selection circuit 34.

Since the output of function generator 46 tends to go negative upon the occurrence of a high negative pressure excursion, the lower selection circuit 34 will produce an output corresponding to the lower of the output of the control output of summing circuit 38 or override signal of summing circuit 50 when the pressure in the furnace has an excursion greater than −5 inch Wg. In other words, the control output of circuit 28 is normally under control, until a highly negative input of circuit 50 takes over through lower selection circuit 34. The output of the signal generator 46 is a swift response which is communicated to the induced draft fan circuit 40 through lower selection circuit 34, summing circuit 36 and interlocks 38. This rapidly changing override signal causes a rapid change in the operation of the ID fan 14 which tends to correct the negative pressure excursion.

The invention illustrated in FIG. 1 includes yet another input to the fan control circuit 30. This input includes a transfer and memory device 52 which is driven by an air flow signal which is provided by suitable means.

If a master fuel trip, occurs, it is a known fact that there tends to be a rapid negative pressure excursion in the furnace 10. While with smaller units this negative pressure excursion has been tolerable in the newer larger units, an occurrence such as a master fuel trip causes a very large pressure excursion which must be compensated for immediately.

The pressure excursion caused by a master fuel trip is compensated for by using a function generator 54 which generates signal illustrated as in FIG. 3C. This signal is a function of both the combustion air flow to the furnace and the percent output of the function generator 54. If, for example, the furnace is operating with 75 percent air flow, then the output of function generator 54 varies by approximately 21% which output is a signal for decreasing the operation of the induced draft fan 14 by that percentage. This is accomplished by an input to fan control circuit 30 through switching circuit 56 to summing circuit 36. This input to the summing circuit 36 which is combined with the output from the summing circuit 28 which controls the fan under normal conditions. The summation of these two signals 36 causes the operating characteristics of the induced draft fan 40 to change and rapidly close so as to compensate for the impending negative excursion sure to occur as the result of the master fuel trip. If the air flow decreases, the output of signal generator 54 decreases, thus causing the compensation to decrease as the air flow itself and the resulting gas flow through the furnace decreases.

In addition to automatic control, an audible plan is provided to positively warn the operations personnel responsible for safe furnace operation.

Alarm triggering circuit 58 is provided which produces an output upon the occurrence of +2 inch or −3 inch Wg. pressure in the furnace. This alarm trigger detects the output of the pressure transducers 18 and 18' through line 42 and delivers its output to a suitable alarm (not shown).

As previously mentioned, it is a feature of the present invention to include at least two pressure detectors 18 and 18' which act as a redundancy check on the accuracy and operation of the system. The pressure detectors 18 and 18' are coupled to a comparator circuit 60 which detects the difference in relative pressure in each pressure output signal of each of the detectors 18 and 18'. A difference of more than ten percent causes actuation of alarm triggering switch 59 which activates a suitable alarm (not shown), a runback switch 48 and auto-manual switch 32.

Operation of alarm triggering switch 59 causes the circuit 32 to switch to manual which requires thereafter that an operator control the operation of the fans. Operation of runback switch 48 disables communication of an override output of function generator 46.

It should be clear that if either one of the pressure detectors 18, 18' disabled, there would be an immediate excursion in the pressure which may not be accurate because of the failure of one of the detectors, if this excursion were detected at the comparator circuit 44, the override signal would be produced through the function generator 46, switch 48, summing circuit 50, lower selection circuit 34 to the fan control circuit 40 to cause a radical change in the operation of the induced draft fan 14. If a pressure detector is rendered inoperative, for purposes of safety, the switch 48 is opened so as to disable any radical corrections on the induced draft fan 14 by the control system of the present invention. In addition, the alarm triggered by switch 59 advises and transfer switch 32 permits the operator to take control.

Manual transfer switch 20 is used to select which of the detectors 18 and 18' will actually deliver the signal being detected at the comparator 22. This manual transfer switch may also be utilized in the event of a failure of one of the pressure detectors 18 and 18' so that the system can be operated upon while the detector is in repair. The manual transfer switch can be utilized to disable the comparator circuit 60 so that the system can operate one pressure detector while the other is being replaced or checked out.

In FIG. 2 there is illustrated a further embodiment of the invention which corresponding parts have been designated by the same reference numerals as part of a "100" series. In this form of the invention pressure detectors 118 and 118' detect the pressure in a furnace 110 in a manner similar to that described with respect to FIG. 1. The outputs of the pressure detectors 118 and 118' are compared at 160 for any deviation greater than about 10%. If no such deviation occurs, the output signals from the pressure detectors 118 and 118' are conducted through manual transfer switch 120 to comparator 122 having an input set point of −0.15 Wg. The output of the comparator 122 is fed to a function generator 124 which has an output configuration similar to that illustrated in FIG. 3A and described previously. The output of the function generator 124 is conducted to a correction circuit 126 which proportionately changes the magnitude of the output of the function generator 124 by a factor of (K) and integrates ( ∫ ) error signals therein. The signal from the correction circuit 126 is coupled to summing circuit 128 which receives air flow demand signal from other sources, as previously explained, for controlling the level at which the fans 112 and 114 are to operate.

The output of the summing circuit 128 is conducted to a lower limit selection circuit 170. This circuit has an input which is produced as a result of measuring the air flow through the furnace which air flow signal is provided by other control systems not shown herein. The output of the measured air flow signal is coupled to a function generator 172 which provides an output which is illustrated in FIG. 3D and is explained below.

In large furnace units utilizing hot precipitator or scrubbers, the furnace 110 gas flow is somewhat sluggish and changes in the induced draft fan 112 and forced draft fan 114 operation do not produce immediate changes in the gas flow through the furnace 110, therefore the air flow demand signal of summing circuit 128, as connected by the output of circuit 126 must be limited, to permit gas flow through the furnace to stabilize. Curve (a) in FIG. 3D represents the output of summing circuit 128 or the demand signal for ID fan suction. The output of function generator, 172, curve (b) in FIG. 3D, represents a limit on the ID fan suction. Function generator 172 may be constructed to produce the output (b) so that the demand for ID fan suction is not excessive. Since demanded air flow may lead actual gas flow through the furnace, the demand, if not satisfied promptly, will be increased. The limit established for ID fan suction is therefore a reason for establishing a stabilized response to demands for increased furnace gas flow. The design of each furnace may require that, function generator 172 be calibrated for the particular furnace when the control system of the present invention is placed in service.

The lower limit circuit 170 selects the lower signal between the corrected gas flow demand output of summing circuit 128 and ID fan suction output of function generator 172. The output of lower limit selection circuit 170 is delivered to comparator 174 which establishes a set point for ID fan suction. The comparator 174 delivers an output which is a function of ID fan suction and the limit output of 170 as a set point.

The suction in the induced draft fan 114 is measured by pressure transducers 176 and 176' which are coupled to a higher selection circuit 178. The circuit 178 produces an output corresponding to the higher one of the outputs of respective pressure transducers 176 and 176'. Alarm trigger 179 produces an output to actuate an appropriate alarm (not shown) when the suction varies beyond certain limits.

It is sometimes desirable to utilize the induced draft fan suction as a parameter in controlling the operation of the induced fan draft. The output signal produced at lower selection circuit 170 is a function of measured air flow and air flow demand. The signal becomes a set point for comparator 174 which receives a signal corresponding to the actual ID fan suction, produced as an output of circuit 178. The output of comparator 174 becomes a compensated demand signal for the control of the ID fan circuit 130. The output of comparator 174 is coupled to proportional conversion circuit 180 which delivers an output voltage changed by factor (K) which is compatible to the ID fan control circuit 130.

The operation of the override circuit including the comparator 144 function generator 146, switch 148, summinng circuit 150 and lower selection circuit 134 is the same as that described in FIG. 1 and is installed for the same reasons that in the event of a negative pressure excursion of greater than −5 inches Wg., the system will react quickly to compensate for the excursion. The override signal produced by function generator 146 is similar to the wave form shown in FIG. 3B.

Similarly the transfer and memory circuit 152 delivers an output to function generator 154 through switch 156 to the summing circuit 136 to control the operation of the fan control circuit 140 upon the occurrence of master fuel trip so that the inevitable negative pressure excursion will be anticipated and controlled by the output of function generator 154.

The switch 159 reacts in a similar manner as described with respect to FIG. 1 to block operation of the override output of 146 at switch 148; switch automanual switch 132 to manual and activate an alarm (not shown). Switch 120 can be used as an operator override for a disabled pressure detector 118, 118'.

A latitude of modification, change and substitution is intended in the foregoing disclosure and in some instances some features of the invention will be employed without a corresponding use of other features. Accordingly, it is appropriate that the appended claims be constructed broadly and in a manner consistent with the spirit and scope of the invention herein.

What is claimed is:

1. A control for regulating pressure excursions in a furnace having forced draft and induced draft fans for creating a desired flow of gasses through said furnace comprising:

pressure detector means located in the furnace being responsive to pressure therein for delivering an output indicative of said pressure;

means for producing a set point signal corresponding to a required furnace pressure range, correction circuit means responsive to the pressure detector means output and the set point signal for delivering a correction output signal, means for delivering a demand output corresponding to the desired gas flow through the furnace, fan control circuit means coupled to at least one of said fans, responsive to said demand output and the correction signal for delivering a control signal, said fan so coupled to the fan control circuit means to be responsive to variations in said control signal to modify the flow of gas through the furnace accordance therewith.

2. The apparatus of claim 1 further including: means for producing an override set point signal corresponding to the excessive furnace pressure excursion, override means responsive to the pressure detector means output and the override set point to produce an override output, said override means coupled to the fan control circuit means for delivering said override signal thereto, said control circuit means responsive to the override signal for modifying the flow of gas through the furnace in accordance with variations in said override signal, the override signal varying at a rate faster than the variations in the control signal for effecting a relatively rapid change in furnace gas flow to compensate for said excessive furnace pressure excursions.

3. The apparatus as described in claim 1 wherein the correction circuit means comprises: a comparator circuit having at least two inputs, one coupled to the pressure detector means and the other coupled to said set point signal corresponding to the required furnace pressure range for producing the correction output signal.

4. The apparatus as described in claim 3 further including: a first function generator coupled to an output of said correction circuit means for providing a variable output in accordance with variations in said pressure detector output signal about said set point.

5. The apparatus as described in claim 4 wherein further including: a proportion and correction circuit responsive to said function generator for modifying the variable output of the function generator output and for integrating fluctuations therein.

6. The apparatus as described in claim 1 further including: a summation circuit responsive to the output of said correction circuit means and means delivering the demand output, said summing circuit producing a control output corresponding to an operating characteristic of the furnace for the particular combustion air flow demand.

7. The apparatus as described in claim 1 including: manual auto switching means for disabling automatic operation of the system by interrupting the control signal from said fan control circuit.

8. The apparatus as described in claim 2 wherein said override means includes a second function generator for delivering a rapidly changing output upon the occurrence of an output of said pressure detector means in excess of the set point corresponding to the excessive furnace pressure excursion.

9. The apparatus described in claim 1 further including: a transfer and memory circuit responsive to combustion air flow to the furnace and a furnace trip condition, said transfer and memory circuit providing an output coupled to the fan control circuit means for controlling the operation of the fan upon the occurrence of the furnace trip condition, said control by said transfer and memory circuit being a function of the precent of air flow through the furnace at the time of said fuel trip.

10. The apparatus as described in claim 9 wherein said transfer and memory circuit includes: a third function generator responsive to gas flow through the furnace for generating a signal proportional to the air flow at the time of said furnace trip.

11. The apparatus as described in claim 1 wherein said pressure detector means includes: at least two pressure transducers each generating outpus indicative of furnace pressure, and a pressure comparator means coupled to each of said pressure transducers for producing an output when the outputs of said transducers deviate in magnitude one from the other by a selected value.

12. The apparatus as described in claim 11 including: means coupled to said pressure comparator for interrupting the control signal upon the occurrence of said selected magnitude deviation of said transducer outputs.

13. The apparatus as described in claim 12 wherein said interrupting means includes a selection switch actuated by said interrupting means for interrupting said control signal.

14. The apparatus according to claim 11 including: means coupled to the pressure comparator for disabling said override circuit output upon the occurrence of said selected deviation.

15. The apparatus according to claim 1 including: circuit means coupled to the output of said override means for engaging the override circuit in preference to the control signal.

16. The apparatus according to claim 15 wherein said means for preferentially engaging the override output includes a lower section circuit responsive to said control output and by said override output, said lower selection circuit selecting the lower one of said signals.

17. The apparatus as described in claim 1 further including: suction detector means coupled to the induced draft fan for determining induced draft fan suction, said suction detector means producing an output and being coupled to the fan control circuit means for modifying the control signal.

18. The apparatus as described in claim 17 wherein said system further includes: a flow detector responsive to furnace gas flow for producing a signal indicative thereof, and fourth function generator means responsively coupled to the flow detector for producing limit output of gas flow demand, and delivering said limit output to the fan control circuit means.

19. The apparatus as described in claim 18 wherein means responsive to said limit output signal and control output signal is coupled to the fan control circuit means for delivering a lower output thereto corresponding to a lower one of said outputs.

20. The apparatus of claim 19 including: a suction detector responsively coupled to one of the fans to deliver an output corresponding to fan suction and a suction comparator responsive to said lower output and the suction detector output for modifying the lower output to said fan control circuit means in accordance with air flow demand as limited by said limit output, and fan suction.

21. The apparatus of claim 20 wherein said suction detector is coupled to the induced draft fan.

22. The apparatus of claim 1 wherein said fan responsive to the fan control signal is the induced draft fan.

23. The apparatus of claim 1 wherein the gas flow demand signal governs the forced draft fan.

* * * * *

UNITED STATES PATENT AND TRADEMARK OFFICE

CERTIFICATE OF CORRECTION

PATENT NO. : 3,985,294

DATED : October 12, 1976

INVENTOR(S) : Paul Vincent Guido and Robert Lenox Criswell

It is certified that error appears in the above-identified patent and that said Letters Patent are hereby corrected as shown below:

Column 1, line 24, delete "-5" and substitute therefor -- -15 --.

Column 7, line 26, after " furnace" insert --in--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*